United States Patent [19]

Goodnow et al.

[11] 4,349,427

[45] Sep. 14, 1982

[54] ALUMINUM REDUCTION CELL ELECTRODE

[75] Inventors: Warren H. Goodnow, Palo Alto; John R. Payne, Pleasanton, both of Calif.

[73] Assignee: Kaiser Aluminum & Chemical Corporation, Oakland, Calif.

[21] Appl. No.: 161,703

[22] Filed: Jun. 23, 1980

[51] Int. Cl.[3] ..... C25C 3/08; C25B 11/12

[52] U.S. Cl. ..... 204/243 R; 204/291; 204/294

[58] Field of Search ..... 204/243 R-247, 204/67, 294, 291, 64 R

[56] References Cited

U.S. PATENT DOCUMENTS

| | | | |
|---|---|---|---|
| 704,393 | 7/1902 | Simon | 204/64 R |
| 4,071,420 | 1/1978 | Foster, Jr. et al. | 204/243 R X |
| 4,219,391 | 8/1980 | Foster, Jr. | 204/67 |
| 4,231,853 | 11/1980 | Rahn | 204/243 R |
| 4,243,502 | 1/1981 | Kugler | 204/290 F X |

FOREIGN PATENT DOCUMENTS

| | | | |
|---|---|---|---|
| 225457 | 1/1979 | U.S.S.R. | 204/243 R |

*Primary Examiner*—Delbert E. Gantz
*Assistant Examiner*—Donald R. Valentine
*Attorney, Agent, or Firm*—Paul E. Calrow; Frank M. Hansen

[57] ABSTRACT

The invention is directed to cathode modules comprised of refractory hard metal materials, such as $TiB_2$, for an electrolytic cell for the reduction of alumina wherein the modules may be installed and replaced during operation of the cell and wherein the structure of the cathode modules is such that the refractory hard metal materials are not subjected to externally applied forces or rigid constraints.

7 Claims, 9 Drawing Figures

ALUMINUM REDUCTION CELL ELECTRODE

The Government of the United States of America has rights in this invention pursuant to Department of Energy Contract No. DE-AC03-76CS40215.

BACKGROUND OF THE INVENTION

1. Field of Invention

This invention relates to an electrode structure for the production of aluminum by electrolysis of alumina dissolved in a molten cryolitic bath, and, more particularly, to a cathode of titanium diboride ($TiB_2$) and other refractory hard metal materials, or mixtures of these materials, such as the refractory carbides and borides of the transition elements, titanium and zirconium, (hereinafter collectively referred to as RHM) in a novel and improved arrangement in electrical systems for electrolytic cells for producing aluminum. Further, the invention relates to a replaceable RHM electrode structure which is easily handled during preheating, installation in the cell and changing of the electrode during operation of the cell.

2. Description of the Prior Art

In the early 1950's, RHM materials were first utilized for cathode constructions in aluminum reduction cells. Titanium and zirconium borides and carbide boride mixtures were found suitable for these constructions, and various cathode constructions are shown in British Pat. Nos. 784,695; 784,696; 802,471 and 802,905 and in U.S. Pat. No. 3,028,324. This RHM cathode development is chronicled in a published paper identified as follows: C. E. Ransley, "The Application of the Refractory Carbides and Borides to Aluminum Reduction Cells," *Extractive Metallurgy of Aluminum,* Volume 2, Interscience Publishers, New York, (1963) p. 487. RHM materials in pure form are very resistant to the molten aluminum and cryolite found in an aluminum reduction cell and moreover generally have higher electrical conductivities than the conventional carbon products used in a reduction cell. In addition, RHM and in particular $TiB_2$ are readily wet by molten aluminum, whereas the carbon products normally used are not.

Although the early use of RHM in aluminum reduction cells was conceptually a significant improvement, such use was fraught with practical problems and as a result the development of RHM cathodes has not met with any significant commercial success.

One major problem faced by the workers in this area was the deleterious effects of oxide in the RHM shapes used in the reduction cell. Normally, the RHM shapes were formed from RHM powder by either hot pressing or cold pressing and sintering. However, the surfaces of the RHM particles were oxidized to a certain extent so that when the powder was pressed into various shapes, a high concentration of oxide resulted at the interparticle or grain boundaries. The integranular oxide could be readily attacked by molten aluminum so that the RHM particles or grains could be easily dislodged after molten aluminum attack at the grain boundaries, resulting in the rapid deterioration of the protective RHM cathode surface. During the early development work on RHM cathode materials, it was well known that the oxide content of RHM shapes must be kept as low as possible to avoid intergranular attack by molten aluminum. However, the art of RHM manufacture was not sufficiently advanced at that time to produce high purity RHM products which could withstand attack by molten aluminum for any significant period. Theoretically, RHM with no oxide content would be best, but such material is impossible to obtain in a commercial process. Lately, several manufacturers have been able to produce $TiB_2$ shapes of a reasonable size with oxide contents less than 0.05% by weight, which makes the $TiB_2$ shapes very resistant to molten aluminum attack even at the grain boundaries where the oxide tends to be concentrated.

Because the RHM materials have a high elastic modulus and low Poisson's ratio, they are quite brittle and subject to thermal shock. As a general rule, RHM shapes should not be subjected to a temperature differential greater than 200° C. to avoid thermal cracking. They are more tolerant to heating up than cooling down conditions.

A particularly attractive aluminum reduction cell design utilizing RHM cathodic surfaces is shown in U.S. Pat. No. 3,400,061, wherein the RHM cathode surfaces are sloped so that only a thin layer of molten aluminum which wets the RHM surface remains. The molten aluminum electrolytically formed during the operation of the cell drains from the sloped surface into the trough or trench located at the middle of the cell. The molten aluminum in the trough is not a part of the electrolytic circuit and can be removed as desired. Only the thin layer of molten aluminum which wets the RHM cathodic surface is involved in current transfer and permits electrolysis operation at a low interpolar or anode cathode distance (ACD) which reduces the energy loss due to the resistance drop in the electrolyte. A significant savings in energy (up to about 25%) would be realized by a low ACD, e.g., one-half inch, over the conventional reduction cells. However, in RHM cathode constructions wherein the RHM material is supported on a carbonaceous substrate, there is a significant problem in that there is an extremely large difference in thermal expansion between RHM shapes and the supporting conductive carbonaceous substrate. The large difference in thermal expansion coefficients (e.g., about $2\times10^{-6}$ v. $8\times10^{-6}$ in/in° C.) precluded forming a bond which would be effective both during installation of the RHM shapes at room temperature and the operating temperature of the aluminum reduction cell (e.g., about 975° C.). Any bond formed at room temperature when the plate or tiles of RHM were installed would be essentially destroyed by the thermal expansion during heatup to operating temperature.

The patents and technical literature are replete with references which describe attempts to solve the various problems in the use of $TiB_2$ and other RHM in the harsh environments of an aluminum reduction cell. Lewis et al in U.S. Pat. No. 3,400,061 and others utilized a mixture of $TiB_2$ and other refractory hard metals with small amounts of carbon to reduce the relatively large thermal expansion of the RHM materials. However, such composites did not have the service life necessary for commercial usage due to their susceptibility of attack by the electrolytic bath. References such as U.S. Pat. Nos. 2,915,442; 3,081,254; 3,151,053; 3,161,579; and 3,257,307 describe RHM cathode bars in various positions. However, the RHM cathode bars usually could not withstand the thermal distortion attendant with such designs and they inevitably fractured due to the brittleness of the RHM.

A recent development of RHM cathode design is that disclosed in U.S. Pat. No. 4,071,420, wherein an array of RHM parts or shapes, such as plates, bars, hollow cylinders and the like, are fastened or embedded at one extremity in the carbonaceous bottom of the cell, while the other extremity protrudes into the cryslitic bath and the parts are arranged preferably in a pattern of regularity beneath the anodic surface area of the carbon anode. However, these arrangements also have difficulties because of the brittleness of the RHM materials leading to a short life of the cathode members of the cell, necessitating premature shutdown of the cell for repairs. This causes a serious interruption of the productivity of the cell.

U.K. Published patent application No. 2,024,864 Jan. 16, 1980) discloses a wettable cathode element which is exchangeable and which is made of titanium carbide, titanium diboride or pyrolitic graphite. Although this cathode element can be replaced during operation of the cell, the subelements of the RHM material are of complex shapes having sharp angles and corners and require the joining by screws and the like. A structure such as proposed would be subject to cracking under the rigors of an electrolytic cell environment.

It has long been recognized that the principal energy loss of the Hall-Heroult cell is due to the resistive loss of the electrolyte in the interpolar gap or anode-cathode distance (ACD). At typical current densities, this drop is about one volt per inch which is 20 to 25 percent of the total cell voltage. Much effort has been expended to minimize the ACD, but commercial conventional cells must operate in excess of one and one-half inches. This requirement is due to the very strong inverse relationship between current efficiencies and ACD. Also, as the ACD is reduced toward one inch, the voltage becomes unstable. These effects are directly or indirectly the result of surface fluctuations of the molten aluminum pad which, in the conventional cell, is the cell cathode. The metal motion is attributable to electromagnetic forces and hydrodynamic forces. The latter are created by the anode gases emerging from the interpolar gap.

The prior art attempts to use RHM materials as cathode material for aluminum reduction cells have all suffered from practical deficiencies that prevent commercial use in Hall-Heroult cells, for example, the lack of achieving a long economic life, the catastrophic failure of the substrate when a localized RHM failure occurred, or the RHM cathode structure lacked dimensional stability thereby the spatial relationship of ACD could not be preserved. The use of RHM, e.g., titanium diboride, cathodes is governed by the economic balance between the cost savings realized from reduced power consumption and the high material cost, coupled with the associated capital investment. The already large capital investment in aluminum reduction smelters favors the retrofitting of cells with $TiB_2$ cathodes rather than the replacement with a new cell design.

BRIEF SUMMARY OF THE INVENTION

Accordingly, it is a primary purpose of this invention to provide for an electrolytic cell for the reduction of alumina an improved RHM cathode structure which, while taking into account the structural weaknesses of RHM materials in an aluminum electrolysis environment, permits the changing of RHM cathode members without shutting down the aluminum electrolysis cell. In other words, a "hot change" of the RHM cathode member can be readily made. Further, the invention provides a modular RHM cathode structure which can easily be installed in existing electrolytic cells which is better able to withstand preheating, transporting to an operating aluminum electrolysis cell and installation and operation therein, said structure being advantageously designed to overcome structural weaknesses of the RHM material.

BRIEF DESCRIPTION OF THE DRAWINGS

The invention will be further understood and the advantages thereof will become more apparent from the ensuing detailed description when taken in conjunction with the appended drawings wherein.

DETAILED DESCRIPTION OF THE INVENTION

Figure 1:
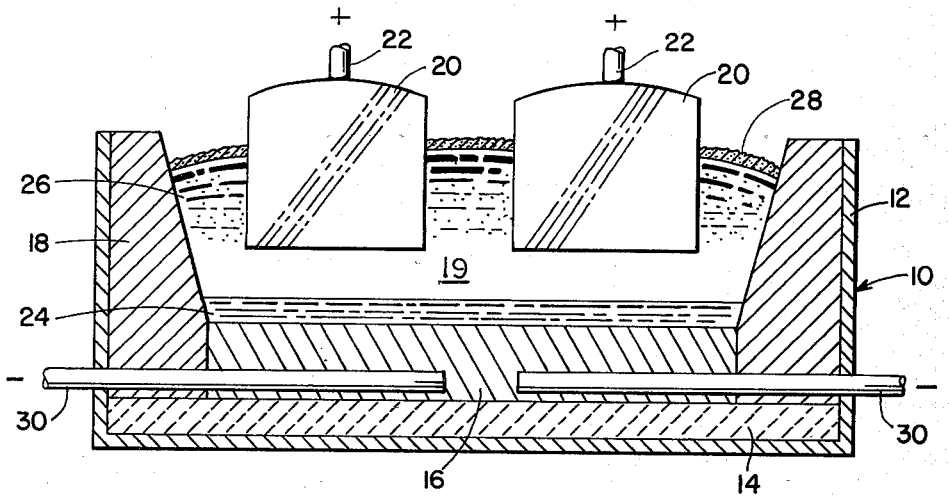
FIG. 1 is a transverse elevation view, partly in section, of a conventional electrolytic cell for the reduction of alumina with prebaked anodes.

With reference to the drawings which are for the purpose of illustrating rather than limiting the invention and wherein the same reference numerals have been applied to corresponding parts, there is shown in FIG. 1 a transverse elevation view, partly in section, of a conventional aluminum reduction cell of the prebake type. The reduction cell 10 is comprised of a steel shell 12 having a layer 14 disposed in the bottom thereof of a suitable insulating material, such as alumina, and a carbonaceous bottom layer 16 in juxtaposition with said insulating layer 14, said carbonaceous layer 16 being formed either by a monolithic layer of rammed carbon paste baked in place or by prebaked carbon blocks. The sidewalls 18 of cell 10 are generally formed of rammed carbon plates; however other materials, such as silicon carbide bricks can be used. The carbonaceous bottom layer 16 and the sidewalls 18 define a cavity 19 adapted to contain a molten aluminum body or pad 24 and a molten body of electrolyte or bath 26 consisting essentially of cryolite having alumina dissolved therein. During operation, a crust 28 of frozen electrolyte and alumina is formed over the electrolyte layer 26. Alumina is fed to the cell by a suitable means (not shown) per a selected schedule. The alumina is dumped onto the frozen crust layer 28, and periodically the frozen crust layer is broken by a suitable means (not shown) to allow the alumina to flow into the bath 26 to replenish same.

Steel collector bars 30 are embedded in carbon bottom 16 and are electrically connected by suitable means at their extremities which protrude through the cell 10 to cathode bus members (not shown). The cell 10 is further comprised of a plurality of carbon anodes 20 supported within the electrolyte 26 by means of steel stubs 22 which are connected mechanically and electrically by suitable conventional means to an electric power source, such as anode rods (not shown), which, in turn, are connected to anode bus members (not shown).

Figure 2:
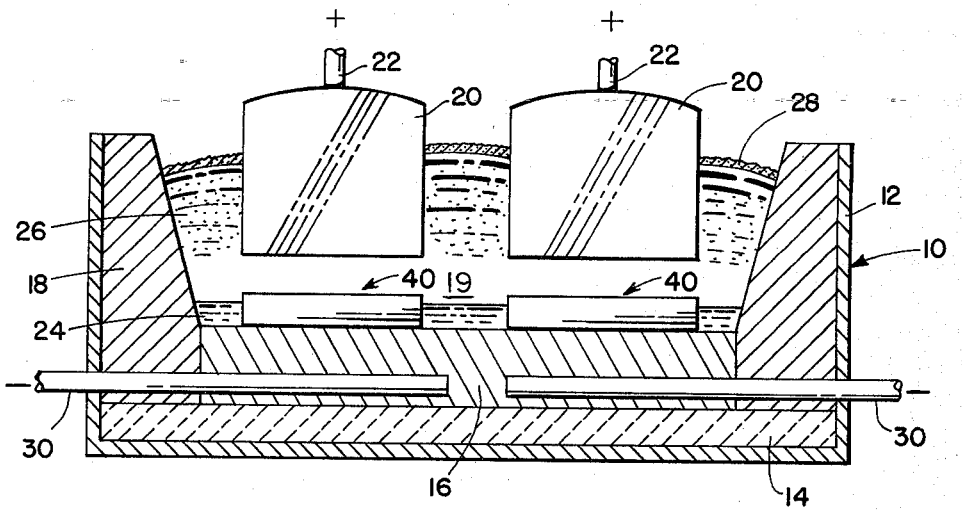
FIG. 2 is a similar view with the replaceable cathode modules of the invention shown schematically.

FIG. 2 depicts the cell 10 of FIG. 1 which has been retrofitted to accommodate replaceable cathode modules 40 which are depicted schematically. The base of the module 40 rests on the bottom carbonaceous layer 16 and extends through the metal pad 24 and the upper portion of the module 40 extends into the electrolyte 26. The modules 40 can be easily installed and removed from the cell 10 without unduly interrupting the performance of the cell. A module may be installed in the cell by a "hot change," that is, without taking the cell out of production.

Figure 5:
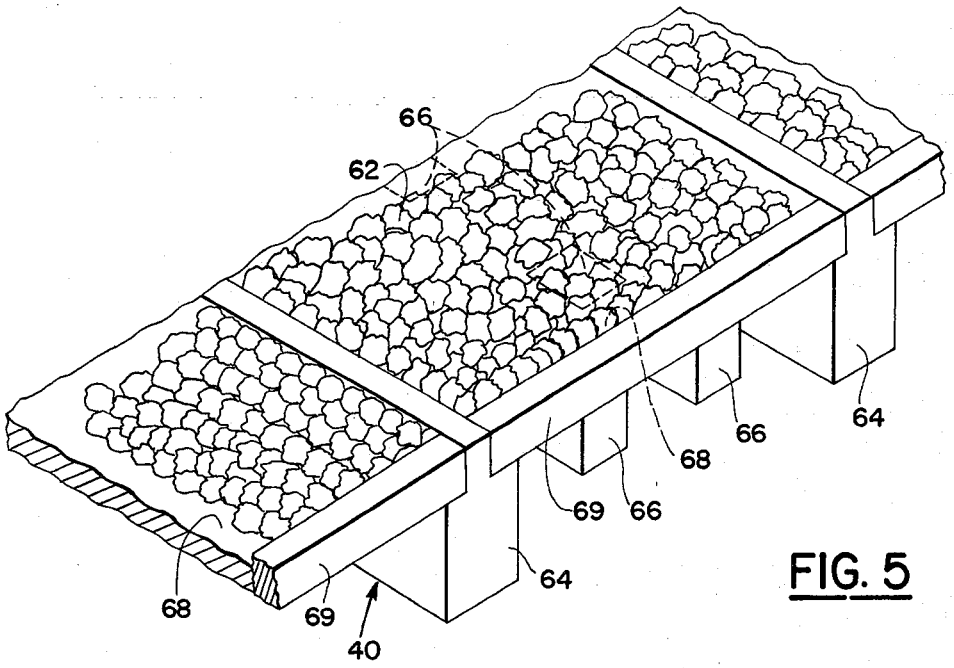
FIG. 5 is a partial view in perspective of a further embodiment of the invention of a cathode module employing small pieces of RHM material described as a shallow packed bed.
Figure 6:
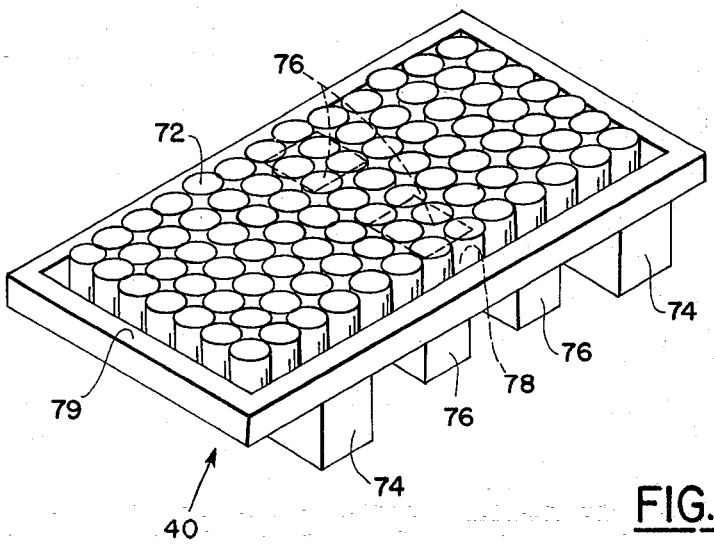
FIG. 6 is a perspective view of a still further embodiment of the invention employing a cathode module of cylinders of RHM material.
Figure 7:
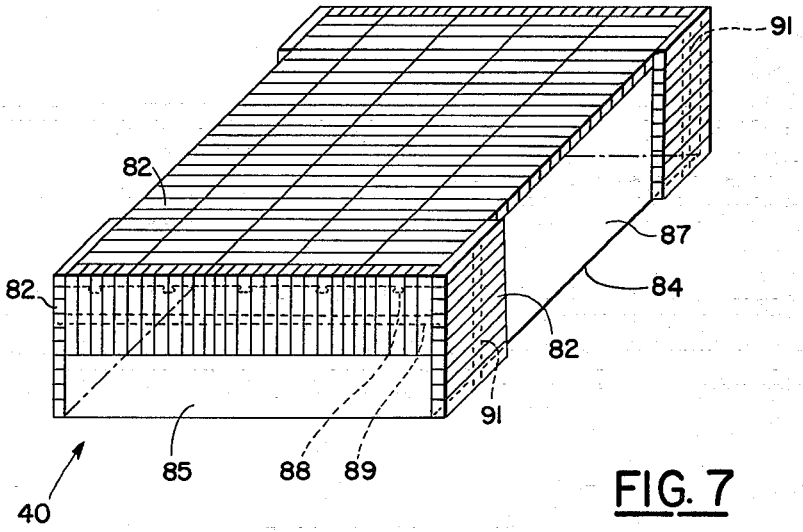
FIG. 7 is a perspective view of another embodiment of the invention of a cathode module employing a plurality of RHM members of a shape which permits interlocking of the RHM members with the substrate member.

The instant invention as depicted in the embodiments of the FIGS. 3–9, inclusive, overcomes the shortcomings of the prior art RHM cathodes for the electrolysis of aluminum. The concept is to utilize a cathode module having an electrically conducting upper surface comprised of a plurality of RHM members, which surface has approximately the same dimensions as the bottom surface of the anode, and the surface of RHM members is positioned within the projection of the bottom surface of the anode. The bottom surface of currently used prebake anodes will vary from about 15 inches by 23 inches to about 35 inches by 60 inches. The module's upper surface is substantially covered with the RHM material, such as titanium diboride, and the upper surface must have an electrical pathway to the molten metal layer, e.g., 24 in FIG. 2. This can be accomplished by covering at least a portion of the sides of the modules with titanium diboride which is in contact with the upper surface of the cathode module as shown in FIG. 7 or by the use of titanium diboride pegs as shown in FIGS. 3–6, inclusive. The free space surrounding the modules (depicted as molten metal layer 24 in FIG. 2) serves as the accumulation volume for the metal that drains from the cathode surfaces. The extent of titanium diboride coverage on the module sides (FIG. 7) or the lengths of the titanium diboride pegs shown in FIGS. 3–6, inclusive, is determined by the high and low metal levels created by cell tapping during operation of the cell.

The replaceable cathode modules 40 of the instant invention have a number of important advantages over previous attempts to utilize RHM materials as cathodic materials in aluminum reduction cells, for example:

1. The quantity of RHM material ($TiB_2$) is minimized.
2. Little modification is required for the existing cell cathode structure or materials.
3. Random failure of a module will not cause failure in another and only a small loss in cell performance would result.
4. Present tapping procedures of conventional cells will still apply.
5. Preassembled and inspected modules can be installed with semiskilled labor.
6. The startup procedure is greatly simplified.
7. A great design flexibility is provided in regard to cathode current flow path.
8. Exposure of titanium diboride parts to cell servicing operations is minimized.
9. It is possible to "hot change" a failed module.
10. Modules can be salvaged from a cell that fails early.

FIGS. 3–9, inclusive, depict advantageous embodiments of the cathode module structures 40 of the invention. Because of the high cost of RHM material, a fundamental consideration in the design of a cathode module is the minimum cathode cost per unit metal production. The unit cathode cost is comprised of material cost, shape fabrication cost, assembly cost and expected service life. When these considerations are coupled with the fracture mechanics approach to brittle material design, then the cathode modules should have the following features:

1. $TiB_2$ is minimized per unit anode area.
2. The cathode modules are not fastened to the cathode bottom.
3. The cathode module must be denser than aluminum, that is, the weight of the module is such that it is to establish a nonfloating relationship with molten aluminum.
4. The shapes of the RHM material ($TiB_2$) must be simple, and shapes, particularly plates, should be in a "free body" state, that is, free of externally applied forces or rigid constraints.
5. The quantity of other materials used in the cathode module should be minimized.
6. A low cathode drop can be readily achievable.

Figure 3:
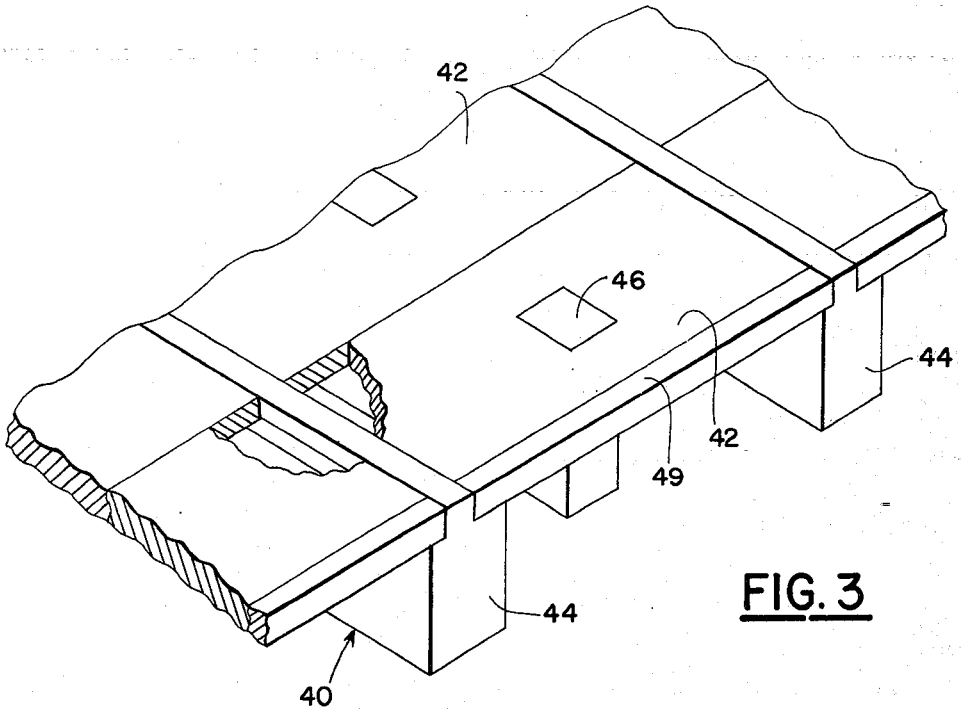
FIG. 3 is a partial view in perspective, and partly in section, of a cathode module of the invention employing plates of RHM material.

FIG. 3 shows a module 40 comprised of $TiB_2$ plates 42 which are supported in a "free body" state by support members 44 of suitable material, such as, silicon carbide (SiC). $TiB_2$ plates may be made by cold pressing and sintering, and typical plates are ¼ inch thick with the horizontal measurements being 4 inch by 4 inch, 6 inch by 6 inch or 4 inch by 6 inch. The support members 44, which rest on the bottom of the cell, could be of $TiB_2$ or graphite which are electrical conductive materials or a composite material comprising a mixture of titanium diboride and at least one of the compounds boron nitride and aluminum nitride; however, the cost of the module would be excessive. To conduct the electrical current between the plates 42 and the aluminum metal pad, there are provided pegs 46 of an electrical conductive material, such as $TiB_2$. The support members 44 are joined to sidewall members 49 which can be of SiC to form a framework for supporting and retaining the $TiB_2$ panels 42.

Figure 4:
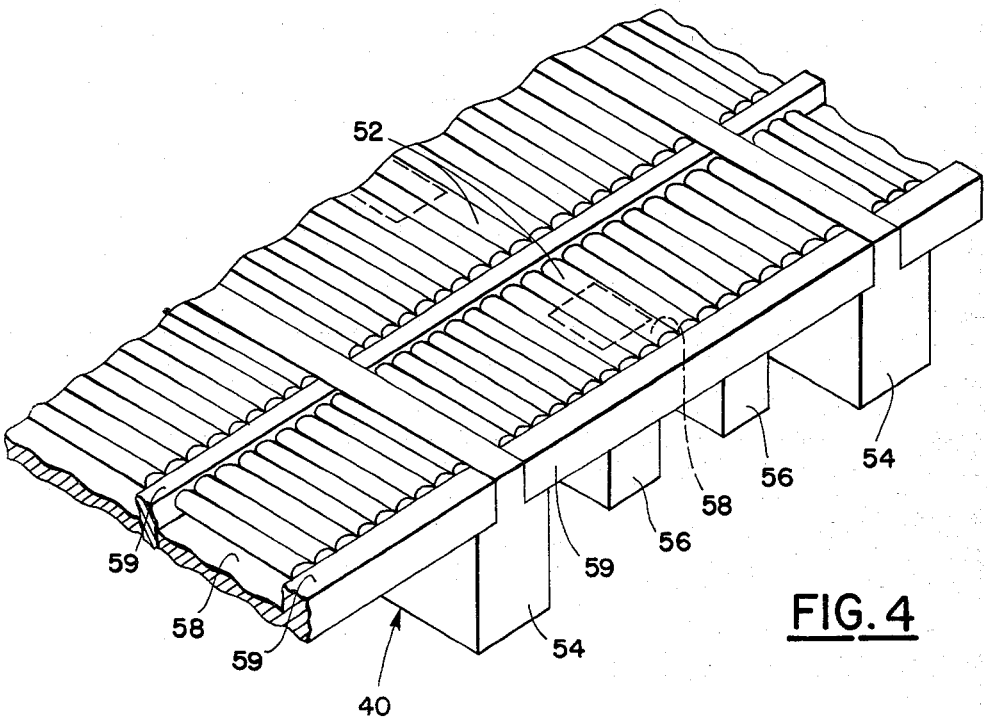
FIG. 4 is a partial view in perspective of another embodiment of the invention of a cathode module employing bars of RHM material.

FIG. 4 shows a cathode module 40 wherein titanium diboride bars are used for the cathodic material. The $TiB_2$ bars are shown as 52 and may be of a size of ½ inch diameter and of a length of 3 inch, 6 inch or longer. The bars, although shown as round in cross section, could also be square or rectangular in cross section. The bars 52 are supported in a "free body" state in a tray member 58 of SiC which has sidewalls 59 for retaining the bars. The tray member 58 is supported by support members 54 of SiC material which rest on the bottom of the cell. $TiB_2$ pegs 56 which are connected to the tray member 58 and in electrical contact with the $TiB_2$ bars form an electrical current path from the bars 54 to the aluminum metal pad.

FIG. 5 depicts a cathode module 40 very similar to that of FIG. 4 except that $TiB_2$ pieces are used instead of $TiB_2$ bars. From a fracture mechanics viewpoint the failure probability is such that small parts last longer. A packed bed is indifferent to failure of individual pieces.

The $TiB_2$ pieces are shown as 62 which are supported in a "free body" state in tray member 68 of SiC having sidewalls 69 for retaining the $TiB_2$ pieces 62. The tray member 68 is supported by support members 64 of SiC material which rest on the bottom of the cell. $TiB_2$ pegs 66 extend through tray 68 and form an electrical current path from the $TiB_2$ pieces 62 to the aluminum metal pad.

FIG. 6 shows a cathode module 40 using $TiB_2$ members 72 which are either solid cylinders or hollow cylinders closed at one end. In the latter case the closed end is placed in the direction that faces the anode bottom surface. The cylinders are free standing without constraint in a tray member 78 of SiC having sidewalls 79 for retaining the cylinders in the tray. The tray 78 is supported by support members 74 of SiC material which rest on the bottom of the cell. $TiB_2$ pegs 76 extend through tray 78 and form an electrical current path from the $TiB_2$ cylinders 72 to the aluminum metal pad.

Figure 8:
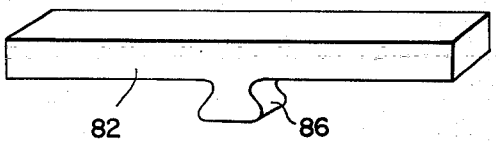
FIG. 8 is a perspective view of an RHM member of the embodiment shown in FIG. 7.

Another embodiment of a cathode module 40 of the invention is shown in FIG. 7. The module 40 has a support member 84 which may be a solid block of SiC or it may be a solid block formed from a mixture of $TiB_2$ with at least one of the compounds boron nitride and aluminum nitride. The RHM portion of the module 40 is comprised of a plurality of particularly shaped $TiB_2$ parts 82, as shown in FIG. 8, wherein the part 82 has an integrally formed tang or projecting portion designated as 86. The module 40 has on its upper surface a series of parallel slots 88 which slots have configurations which mate with the tang or tongue 86. When the $TiB_2$ parts 82 are positioned in the slots 88 as shown in FIG. 7, the $TiB_2$ parts 82 are positioned and held in place without subjecting the $TiB_2$ material to constraints. In order that the $TiB_2$ parts 82 of the top surface of module 40 are held in place during operation and are electrically connected to the metal pad during operation, rows of $TiB_2$ pieces are positioned on the end surfaces 85 and side surfaces 87 of the module 40. On the end surfaces 85, there are provided slots 89 of a configuration matching that of tang 86; said slots being in a plane parallel to the top surface of the module 40. The placement of the $TiB_2$ pieces in the slots 89 will prevent the $TiB_2$ pieces 82 in slots 88 from disengagement during operation. Side surfaces 87 of module 40 at the corners thereof are provided with slots 91, which have a configuration matching the tang 86 of $TiB_2$ pieces 82 and which are perpendicular to the top surface of the module 40. The bottom $TiB_2$ piece 82 in slots 91 can be locked in place by suitable means. As shown in FIG. 7, when the $TiB_2$ pieces 82 are in place in the slots 88, 89 and 91, the $TiB_2$ pieces 82 are confined or interlocked in place without subjecting the $TiB_2$ pieces 82 externally applied loads or constraints and an electrical path to the metal pad is provided.

Figure 9:
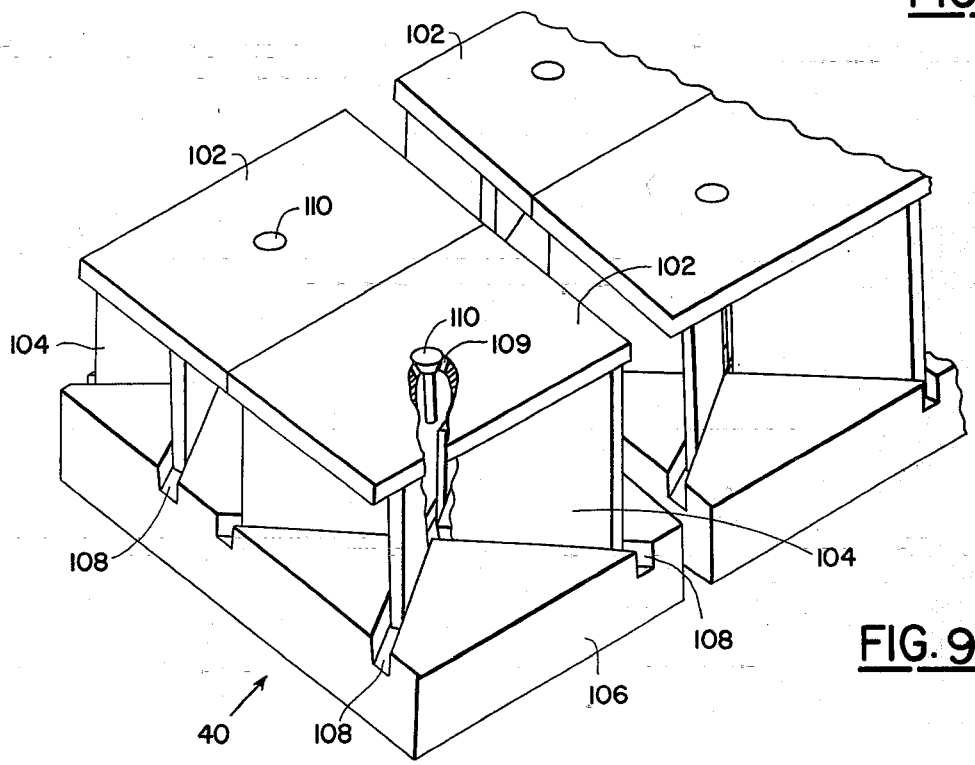
FIG. 9 is a partial view in perspective of a further embodiment of the invention employing plates of RHM material.

FIG. 9 depicts yet another embodiment of a cathode module 40. In this embodiment there is a pedestal 106 of a suitable material, such as silicon carbide or graphite, in which there are a plurality of grooved slots 108 machined in the upper surface; the slots 108 for positioning vertical $TiB_2$ support plates 104. The slots 108 are so positioned that a group of four support plates 104 are in angular relationship to each other such that the angle between adjacent plates 104 is 90°. Other angular arrangements between adjacent plates 104 could be used. When the vertical support plates 104 are positioned in the slots 108, the group of four form a support, in "free body" state, for the horizontal $TiB_2$ plate 102. In order to prevent lateral shifting or movement of the plates 102, the vertical plates 104 in groups of four, are positioned in slots 108 so that there is an open space at the central or hub location where the slots, or the projections of the slots, intersect. The plates 102 are provided with holes 109 having chamfered surfaces which will accept $TiB_2$ pins 110 which extend into the open space to retain the plates 102 in position and prevent lateral movement or shifting.

In order to retain the vertical plates 104 in the slots 108 during transport, preheating, and installing in the cell the plate may be glued in the slots with an aluminum phosphate cement which incorporates silicon carbide grit. Alternatively, the vertical plates 104 could be formed with a bulbous edge to mate with slots 108 which would be provided with a cross section to accept the bulbous edge in a fit that would allow for expansion of the materials.

In order to prevent thermal shock, the cathode modules are preheated in a suitable preheating furnace prior to installation in the electrolytic cell. The modules should be heated to within approximately 50° C. of the cell temperature. In order to prevent thermal shock during the hot transfer, the module may be covered with a suitable insulation material, for example, refractory fibrous materials of aluminum silicate. These materials are readily available, and typical examples are Fiberfrax and Kaowool which are marketed under Registered Trademarks of Carborundum Co. and Babcock & Wilcox Co., respectively. The insulating material is placed over the module prior to placing in the preheating furnace and can be left on during transport and placing the module into the cell. The insulating material dissolves in the bath and does not affect the aluminum metal or operation of the cell. The cathode module can be placed in the preheating furnace, transported and placed into position in the cell by suitable tong mechanisms.

Advantageous embodiments of the invention have been shown and described, and it is obvious that various changes and modifications can be made therein without departing from the appended claims.

We claim:

1. In an electrolytic cell for the reduction of alumina having a cavity lined with refractory material and adapted to contain a molten aluminum body and a body of molten electrolyte containing dissolved alumina, at least one prebake anode depending into said cavity and a cathode of a refractory hard metal at the bottom of said cavity beneath said anode, said anode and cathode being in electric circuit relationship, the improvement comprising a replaceable modular cathode assembly having an electrically conducting surface comprised of a plurality of refractory hard metal members, which surface is positioned beneath the anode and within the projection of the bottom surface of the anode, said assembly having a structure that is free standing and resting upon the bottom of the cavity and adapted to extend into said electrolyte and wherein the refractory hard metal members are free from externally applied forces or rigid constraints.

2. A modular cathode assembly according to claim 1 wherein the refractory hard metal consists essentially of titanium diboride.

3. The improvement of claim 1 wherein the refractory hard metal surface of the modular cathode assembly and the bottom surface of the anode are approximately equal in area.

4. A modular cathode assembly according to claim 1 wherein the assembly includes a support member of a substrate material for supporting the refractory hard metal members.

5. A modular cathode assembly according to claim 4 wherein the substrate material is SiC.

6. A modular cathode assembly according to claim 4 wherein the substrate material is graphite.

7. A modular cathode assembly according to claim 4 wherein the substrate material comprises a mixture of titanium diboride and at least one of the compounds boron nitride and aluminum nitride.

* * * * *